United States Patent [19]

Smith, Jr. et al.

[11] 4,145,168

[45] Mar. 20, 1979

[54] FLUID FLOW ROTATING MACHINERY OF LOBE TYPE

[75] Inventors: Roy H. Smith, Jr., Houston, Tex.; Bobby J. Travis, 345 Mayhaw St., Vidor, Tex. 77662

[73] Assignee: Bobby J. Travis, Vidor, Tex.

[21] Appl. No.: 741,505

[22] Filed: Nov. 12, 1976

[51] Int. Cl.[2] ..... F01C 1/08; F01C 1/18; F01C 21/00

[52] U.S. Cl. ..... 418/150; 418/189; 418/191; 418/196; 418/206

[58] Field of Search ..... 418/150, 189–191, 418/196, 205, 206

[56] References Cited

U.S. PATENT DOCUMENTS

| | | | |
|---|---|---|---|
| 378,042 | 2/1888 | Dow | 418/189 |
| 1,382,580 | 6/1921 | Webb | 418/206 |
| 3,089,638 | 5/1963 | Rose | 418/150 |
| 3,574,490 | 4/1971 | Hartmann et al. | 418/190 |
| 3,584,984 | 6/1971 | Majkowski et al. | 418/196 |
| 3,612,735 | 10/1971 | Graham | 418/189 |

FOREIGN PATENT DOCUMENTS

| | | | |
|---|---|---|---|
| 2253 | 10/1890 | Fed. Rep. of Germany | 418/191 |
| 1653900 | 9/1970 | Fed. Rep. of Germany | 418/190 |
| 396801 | 8/1933 | United Kingdom | 418/191 |
| 856991 | 12/1960 | United Kingdom | 418/206 |
| 125860 | 5/1960 | U.S.S.R. | 418/190 |

*Primary Examiner*—John J. Vrablik

*Attorney, Agent, or Firm*—Roy H. Smith, Jr.

[57] ABSTRACT

A positive displacement device utilizing at least two rotors which roll sealingly on one another at a common pitch surface speed. Outwardly extending lobes on one rotor sealing engage the cylindrical bore of the housing of the device, fluid traversing the device circumferentially in the annulus between such bore and the pitch surface of the rotor. Speed of rotation of the two rotors is controlled by a timing chain running between sprockets mounted on the rotor shafts.

When the lobe passes the line of sealing contact, a cavity is provided in the meshing rotor, and the lobe makes sealing contact with the wall of this cavity during at least that interval when there is no sealing contact between the pitch surfaces, i.e., the interval when the mouth of the cavity is passing through dead center. The inventor shows that the cavity is a modified path he calls the reentrant loop of an endoepicycloid, which is the path of the tip of a fixed radial extension of one circle as it rolls without slipping around the circumference of a second, fixed circle. From this he shows that, to accommodate a lobe having the general shape of an isoceles triangle truncated or blunted by a radial tip, the endoepicycloid should be split into two halves which are moved apart circumferentially the length of the arc of the lobe tip, and the inside ends of the halves joined by an arc centered on the center of the cavity rotor. Further modifications such as undercutting to avoid double sealing are also described.

11 Claims, 12 Drawing Figures

$$r^2=(a+b)^2+(b+h)^2-2(a+b)(b+h)\cos\frac{a}{b}U$$

$$x=(a+b)\cos U-(b+h)\cos\left(\frac{a+b}{b}\right)U$$

$$y=(a+b)\sin U-(b+h)\sin\left(\frac{a+b}{b}\right)U$$

WHEN $a=b$ $$r^2=4a^2+(a+h)^2-4a\ (a+h)\cos U$$

$$x=2a\cos U-(a+h)\cos 2U$$

$$y=2a\sin U-(a+h)\sin 2U$$

fig.10
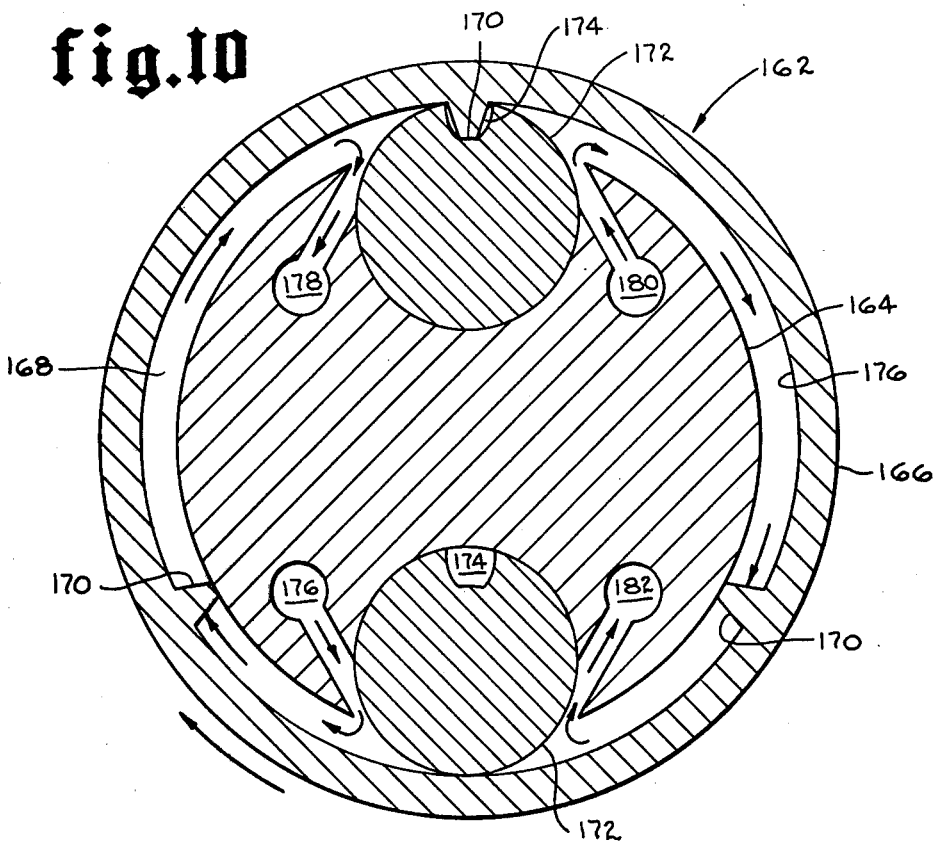
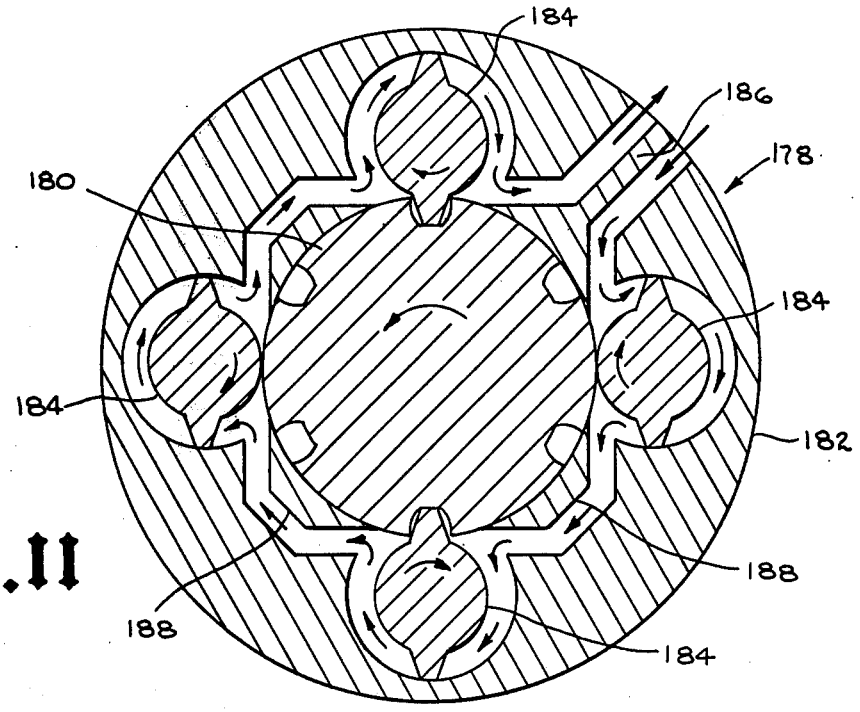
fig.11

FLUID FLOW ROTATING MACHINERY OF LOBE TYPE

CLASSIFICATION

The present invention is a positive displacement rotating hydraulic machine, and may be properly classified with either rotary pumps or rotary hydraulic motors. More specifically, it involves two or more intermeshing rotors at least one of which has a number of lobes protruding from its circumference and another has cavities interrupting its circumference. The lobe enters the cavity and forms a moving seal with the cavity wall during those intervals when a seal is not provided by direct contact between the circumferential surfaces of the rotors. During non-meshing intervals such surfaces, herein called pitch surfaces, contact each other to maintain the desired seal.

BACKGROUND

In an idealized arrangement, a rotor would have a single blade or lobe of neglible width extending radially from its circumference across the annulus separating it from a concentric housing, with which the tip of the blade would make perfect sealing contact. Both annulus and housing would extend a full 360 degrees, as both the beginning and the end of a revolution would be marked by a radial slot in the housing, such slot having a zero width. At the start of a revolution the single blade would be aligned with this slot and a radial gate would be inserted just behind it, forming a seal with the rotor. Pressurized fluid would be introduced between gate and blade, and flow would continue as the blade raced around its annular path, carrying the rotor with it. With no back pressure, high speed and high horsepower would be developed, limited only by friction in the bearings and at the rotating seals.

To continue this idealized state of affairs beyond a single revolution, the gate and slot would have to have a number of unusual operating characteristics. In the very small time interval when the blade of the rotor is passing the space occupied by the gate, the gate would have to retreat into the housing, only to reappear immediately behind the moving blade. A discharge orifice located adjacent the gate would depressurize the motive fluid behind the blade, now occupying a full 360 degrees, so that the blade might make a second revolution without any substantial back pressure.

SHORT STATEMENT OF THE INVENTION

The present invention eschews any attempt to use single rotor structures and in-and-out gates, but does strive to approach the ideal with a pair of rotors in which a gate or lobe on one rotor pops into and out of a slot or cavity in a meshing rotor. The rotors are mounted on parallel axes, and are sized so that ordinarily their cylindrical outer surfaces form a tight seal. Fluid is introduced between the rotors on one side of this seal, transported a little less than 360 degrees around one or both of the rotors in an annulus traveled by the lobes, and discharged on the opposite side of the seal. The function of the cavity is to provide a surface against which the meshing lobe on the opposed rotor forms a moving seal, so that fluid can not flow directly between the rotors.

The primary difficulty faced by the present inventor was that of defining the exact shape of the cavity to provide such a sealing surface. Through cut and try methods aided by mathematical analysis it was determined that this shape, for a single point on the tip of the lobe, is what might be called the reentrant loop of an endoepicycloid. An epicycloid is the path described by a point on the circumference of one wheel as it rolls without slipping around the circumference of a second wheel, and an endoepicycloid is the path of a similar point lying on an extended radius of the rolling wheel, as though located on an overhanging flange. The path described by such rolling point is mostly external to the wheel being rolled upon, but it also includes a closed reentrant loop, the important part of which lies within such wheel.

It has been determined that such loop of the endoepicycloid, which might also be called an epitrochoid, will accommodate in the desired sealing relationship a lobe of chisel (isoceles) configuration, having a height equal to the depth of the endoepicycloidal cavity, and having a base width up to about equal to its height. The only limitation is that such a lobe must have a relatively sharp tip, essentially only a line.

To avoid this limitation, i.e., to give the tip of the lobe some width, it is only necessary to realize that each point of the lobe profile will generate its own endoepicycloid as the two rotors turn at the same circumferential speed (and the same angular speed when the rotors have the same radius). For a lobe which is only a radial line in cross section, each point lying between the tip and the circumference will describe a path lying entirely inside the endoepicycloidal loop described by the point at the maximum radius, the tip, making such loop the complete path for a lobe in the form of a thin blade. When such tip is widened enough to form two corners, if such corners have the same radius they will describe identical endoepicycloidal loops. The pair of loops are displaced from each other circumferentially by the arc length between the corners, and the cavity is then defined by a composite of three lines or surfaces, the leading surface being a half-endoepicycloidal loop which makes sealing contact with the leading corner of the meshing lobe and the trailing surface being the mirror image of the leading surface.

Such leading and trailing surfaces are connected by the bottom surface of the cavity, which makes sealing contact with points on the lobe tip lying between its leading and trailing corners. The profile of the bottom surface will, of course, depend on the shape of the lobe tip. Most simply both of these surfaces are cylindrical about their individual axes, the cavity surface having a radius equal to the difference between that of its outer (pitch) surface and the height of the lobe, while the lobe tip radius is the sum of such height and the radius of its rotor surface. Other profiles are possible but are more complicated. When the lobe tip is squared off, i.e., defining a flat surface parallel to a tangent to the lobe rotor, care must be exercised because the bottom surface of the cavity must have a greater depth at its corners than at its center, corresponding to the greater radial height of the lobe at its two corners. If the bottom surface is not formed in this manner, but is only made as a circular arc connecting the inner tips of the leading and trailing surfaces, a leakage gap will exist between the lobe tip and the bottom surface when the leading and trailing surfaces are not engaged. The simple remedy is to form the lobe tip with a rounded configuration, and match it with a simple cylindrical surface on the cavity bottom.

A cavity as described up to this point is sufficient for many applications, even though it leaves out of sight the fact that there will be short periods of double sealing. Specifically, when the leading corner of the lobe first contacts the leading surface of the cavity, the cylindrical pitch surfaces of the rotors will still be in contact, and this condition will prevail for a part of the time during which the leading corner climbs up the leading surface of the cavity. The same is true during the last phase of intermesh, i.e., there is a double seal during the last part of the engagement of the trailing corner of the lobe with the trailing surface of the cavity. During such double sealing intervals, a volume of fluid may be trapped, and if the fluid is incompressible and the space available either decreases or increases, undesirable results may follow. Compression will cause hammering and bearing wear, if not outright stalling, while expansion may cause cavitation.

The remedy is to eliminate one of the seals during the period when such duplicate sealing would occur. Most simply, this is accomplished by removing material on the cavity rotor, either from the cavity wall or from the pitch surface itself. The designer does this by laying out on his graph models of the intermeshing rotors to show in a first view the positions they occupy at the instant of the first contact between leading corner and leading surface, at the mouth of the cavity; this will show the point of contact from which undercutting of one or both of the pitch surfaces must begin, and continued on up to the cavity mouth (and repeated on the reverse side, if deemed necessary).

The second graphical model will show the relative positions of the rotors, with lobe and cavity as heretofore described, at the instant when the pitch surfaces are about to lose their sealing contact. This occurs when the intersection of the trailing surface of the cavity with the pitch surface of its rotor passes through a line connecting the centers of the two rotors, and determines for that instant the position of the leading corner of the lobe on the leading surface of the cavity. From that point out to the mouth of the cavity the leading surface is undercut to prevent any moving seal over such interval, and repeated on the trailing surface as desired. If the undercutting is accomplished on both surfaces and includes removing the corners of the cavity mouth, the points of beginning the undercutting will necessarily be shifted closer to the mouth, but this can readily be determined and calculated by the designer.

The elimination of double sealing by undercutting the cavity walls has an additional advantage. During any period when a lobe is engaging and sealing against a cavity wall, only the trailing flank of the lobe can be exposed to the high pressure fluid, and the resulting force produces a countertorque on the lobe and makes its rotor dormant. When the cavity wall is undercut so that high pressure fluid flows around the trailing corner of the lobe before such corner reaches the mouth of the cavity, both flanks of the lobe are exposed to the high pressure fluid. In effect, the undercutting reduces the angle of rotation over which the lobe rotor is inactive, or in other words this rotor becomes active for a larger fraction of each revolution.

From the above brief description, it will be apparent that the lobes and cavities disclosed herein are not gear teeth, and that the rotors are not gears. No torque is exerted by one rotor on the other, and no power is transmitted. To control the speed of one rotor relative to the other and thus insure that the lobes will enter the cavities in the proper sequence, any suitable meas such as conventional timing gears or timing chains extending between sprockets on the rotor shafts. The exchange of power is always between the fluid and the rotors, the fluid driving the rotors in the case of a hydraulic motor and vice versa in the case of a pump.

BRIEF DESCRIPTION OF THE DRAWING FIGURES

The present invention may perhaps be better understood by reference to the accompanying drawing forming a part of the present disclosure. In the drawing:

FIG. 10 is another cross section, this one of a device having a stator containing two small rotors containing only cavities which mesh with lobes protruding inwardly from a large planetary rotor surrounding the stator.

FIG. 11 is a cross section of a device which is somewhat the reverse of the previous figure, having an annular stator surrounding a central rotor, the stator housing a number of small lobed rotors which mesh with the larger central rotor.

DETAILED DESCRIPTION

Figure 1:
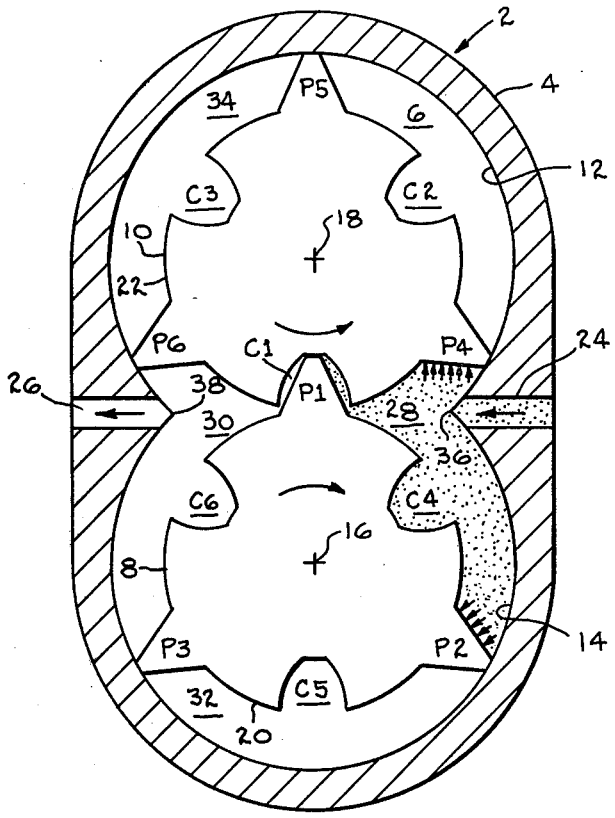
FIG. 1 is a cross section of a rotating machine illustrating the present invention, in somewhat schematic form.
Figure 8:
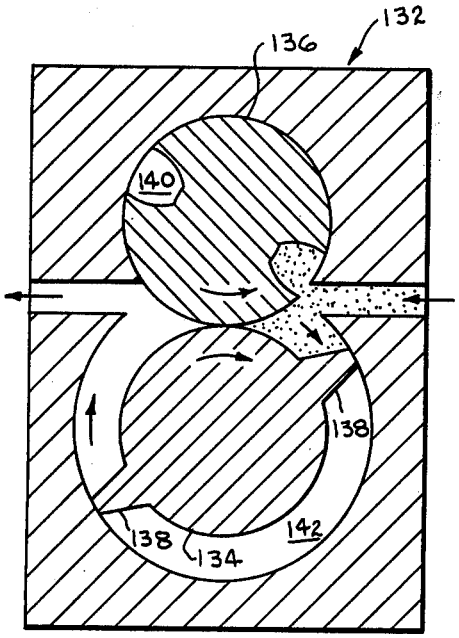
FIG. 8 is a schematic cross section of a rotary device of the invention, similar to that shown in FIG. 1 but having only lobes on one of the two rotors and only cavities on the other.

FIG. 1 illustrates in cross section a rotary device 2 of the invention comprising a housing 4 defining a chamber 6 of the indicated "FIG. 8" configuration - or, more accurately, two slightly truncated cylindrical chambers with the truncated portions arranged back-to-back. A pair of rotors 8 and 10 are rotatably disposed in these two chambers, such rotors being coaxial with the bores 14 and 12 respectively, on shafts not shown which are parallel to each other and are, respectively, centered on the longitudinal axes 16 and 18 of the chambers. The rotors 8 and 10 are of equal radius, and the centers 16 and 18 are spaced apart by two radii, so that the cylindrical pitch surfaces 20 and 22 contact each other in a fashion which is at the same time sealing and non-interferring. Either timing gears or timing sprockets with a chain between them (not shown) are secured to the shafts to insure that the rotors will turn at the same speed, and will prevent either pitch surface from slipping over the other. Transverse passageways 24 and 26 through housing wall 4 permit the flow of a fluid into and out of the spaces 28 and 30 at the center of the chamber on either side of the contact area of the two rotors.

As illustrated, the rotors 8 and 10 are identical, each having three identical lobes denominated P1, P2 and P3 on lower rotor 8 and P4, P5 and P6 on upper rotor 10. In each case the lobes are centered on radii spaced at 120-degree intervals, and midway between each pair of lobes is a cavity denominated C1, C3 and C2 for the upper rotor 10 and C4, C5 and C6 for lower rotor 8. The numbering is chosen to indicate which lobe engages which cavity; thus P1 engages C1, P6 engages C6, etc., in the order dictated for the directions of rotation shown in the figure. Each lobe has a radial height "h", which is also the radial width of the annuli 32 and 34 between the pitch surfaces and the bores of the two chambers.

The general operation of the device 2 will be evident to the reader. Visualizing its use as a motor, high pressure fluid will be flowing into the chamber 28 through inlet 24, as indicated by the flow arrow. At the moment depicted in the figure, only the active high pressure fluid has been shaded, as fluid trapped between adjacent lobes sealing against the bore can have no effect, as between P4 and P5, or between P2 and P3. In the upper part of high pressure chamber 28 a pressure force will act against the lower surface of lobe P4, causing rotor 10 to rotate as shown, while in the lower part of this chamber liquid pressure against the upper surface of lobe P2 causes clockwise rotation. Actually, during the short period of time when lobe P1 makes sealing contact with cavity C1, the clockwise force on P2 will be nullified by an identical force in the counter-clockwise direction exerted on lobe P1 by the high pressure fluid in cavity C1, but during the same sealing interval an extra force is exerted on the wall of cavity C1 by the same fluid, aiding and adding to the force exerted on lobe P4, i.e., both forces produce counterclockwise torque. It should be noted that, even during the short interval when the seal is provided by lobe P1 contacting the wall of cavity C1, there is no net countertorque on the lower rotor 8, i.e., no torque opposing that which rotates it in the indicated direction. Rotor 8 is simply dormant during this short period.

With such usage, at the moment shown in the figure all upper lobes P4, P5 and P6, and lower lobes P2 and P3 are making sealing contact with the borewalls of the housing chamber 6. Fluid port 26 is vented to the outside to serve as an exhaust conduit, making 30 a low pressure exhaust chamber. No fluid flows through annuli 32 and 34 except between adjacent lobes, and no fluid flows directly from high pressure chamber 38 to low pressure chamber 30. It may also be noted that the device is self-starting from the "top dead center" position of the rotors shown in FIG. 1, a statement which can not be made for all lobe motors.

As rotation continues from the FIG. 1 position, lobe P1 and cavity C1 disengage and pass to the right. Pitch surface 20 and 22 come into contact along a line perpendicular to the line connecting their centers, and effectively seal against one another to prevent any fluid flow between the two rotors. Until lobe P1 reaches the edge 36 joining upper borewall 12 with lower borewall 14, the high pressure fluid continues to act on lobe P2, and thereafter P1 becomes the effective lobe. At about this same time lobe P6 will reach the corresponding edge 38 of the exhaust chamber, dumping the fluid between P6 and P5 into the exhaust.

Further rotation will cause lobe P6 of the upper rotor 10 to engage cavity C6 as they approach, reach and pass top dead center, followed by a period of center sealing between pitch surfaces 20 and 22, after which lobe P3 engages cavity C3, etc. The reader should keep in mind that rotation of the rotors is carefully controlled by such means as timing gears or chains (not shown) so that there is no slippage between the pitch surfaces, i.e., the surface speeds of the pitch surfaces are equal. Only when this is kept in mind can it be appreciated that sealing engagement of a lobe with a cavity, to be further described below, is a viable concept.

Figure 2:
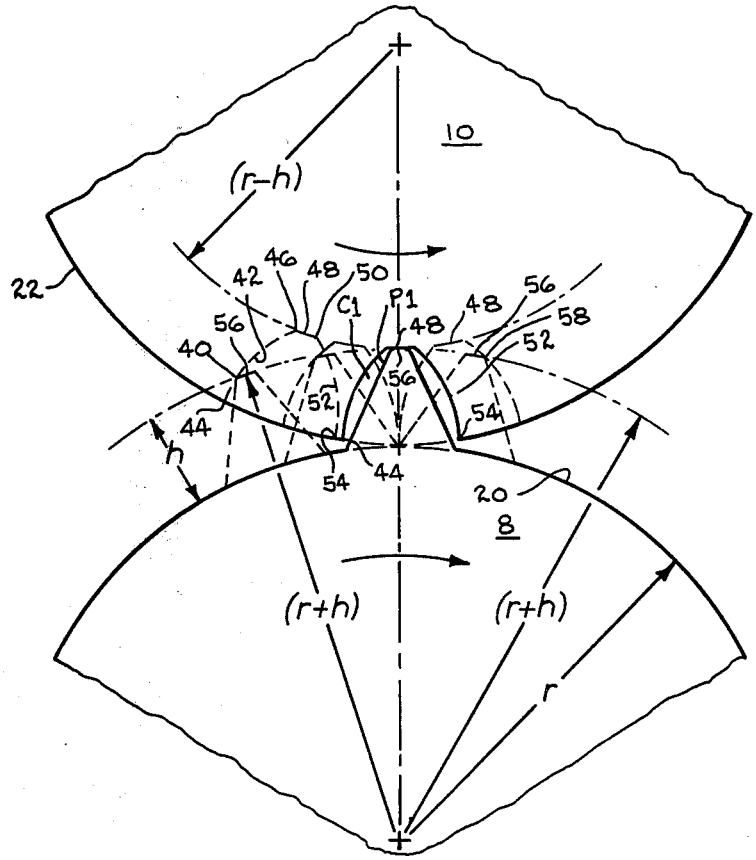
FIG. 2 is a layout showing successive positions of a lobe and cavity as they engage one another during rotation of their rotors.

FIG. 2 is a layout showing how a lobe such as P1 of a rotor of the previous figure progresses through one of the cavities C1 of the meshing rotor. Only four positions are shown, in the interest of clarity, and the first or left hand disposition is shown after the lobe has already entered the cavity, the leading corner 40 of lobe P1 being in sealing and sliding contact with the leading surface 42 of cavity C1. The cavity is one designed and operable for continuous sealing contact with some part of the lobe, from the mouth corner 44 all the way up leading surface 42 to the latter's junction 46 with the arcuate bottom 48 of the cavity, to the junction 50 of the bottom surface with trailing sidewall 52, all the way down to the other mouth corner 54. This continuous contact may be modified by undercutting, as discussed below in connection with FIGS. 7A and 7B, but such modification is not necessary for all applications of the device. For this purpose, it should be noted that, whereas in the first position shown in FIG. 2 there is still direct sealing contact between pitch surfaces 20 and 22, in the second position from the left, when corner 40 of the lobe has climbed about 3/4ths of the length of surface 42, these surfaces 20 and 22 are just about to break contact. Compare with the third position from the left, wherein surfaces 20 and 22 are out of contact.

As corner 40 of the lobe reaches the end 46 of leading cavity surface 42 and starts to move away from it, the point of contact shifts to one between lobe tip 56 and bottom surface 48 of the cavity. Although these surfaces may have various configurations, as explained below, in a preferred embodiment they are both circular arcs, tip surface 56 being centered on the center of its rotor with a radius of $r + h$, where h is the radial height of the lobe, while cavity bottom 48 is centered on its own rotor center and has a radius of $r - h$. The arc length of tip 56 is dictated by the strength desired in the lobe for anticipated operating conditions, and the arc length of bottom surface 48 is made equal to this arc length of the lobe. Thus tip 56 rolls around bottom 48 just as the two pitch surfaces 20 and 22 roll on one another until the trailing corner 58 of the lobe rolls into the corner 50 marking the intersection of cavity bottom 48 with the trailing surface 52 of the cavity, as shown in the fourth or right hand sketch of the two members.

In this last sketch it should be noted that, although corner 58 is only a third or a quarter of its sealing traverse down the trailing surface 52 of the cavity, the pitch surfaces 20 and 22 of the two rotors have just rejoined their sealing contact, at the left hand corner 44 of the cavity mouth. From such time on until corner 58 reaches the right hand corner 54 of the mouth, there will be two simultaneous seals, unless one of them is undercut or otherwise removed.

Figure 3:
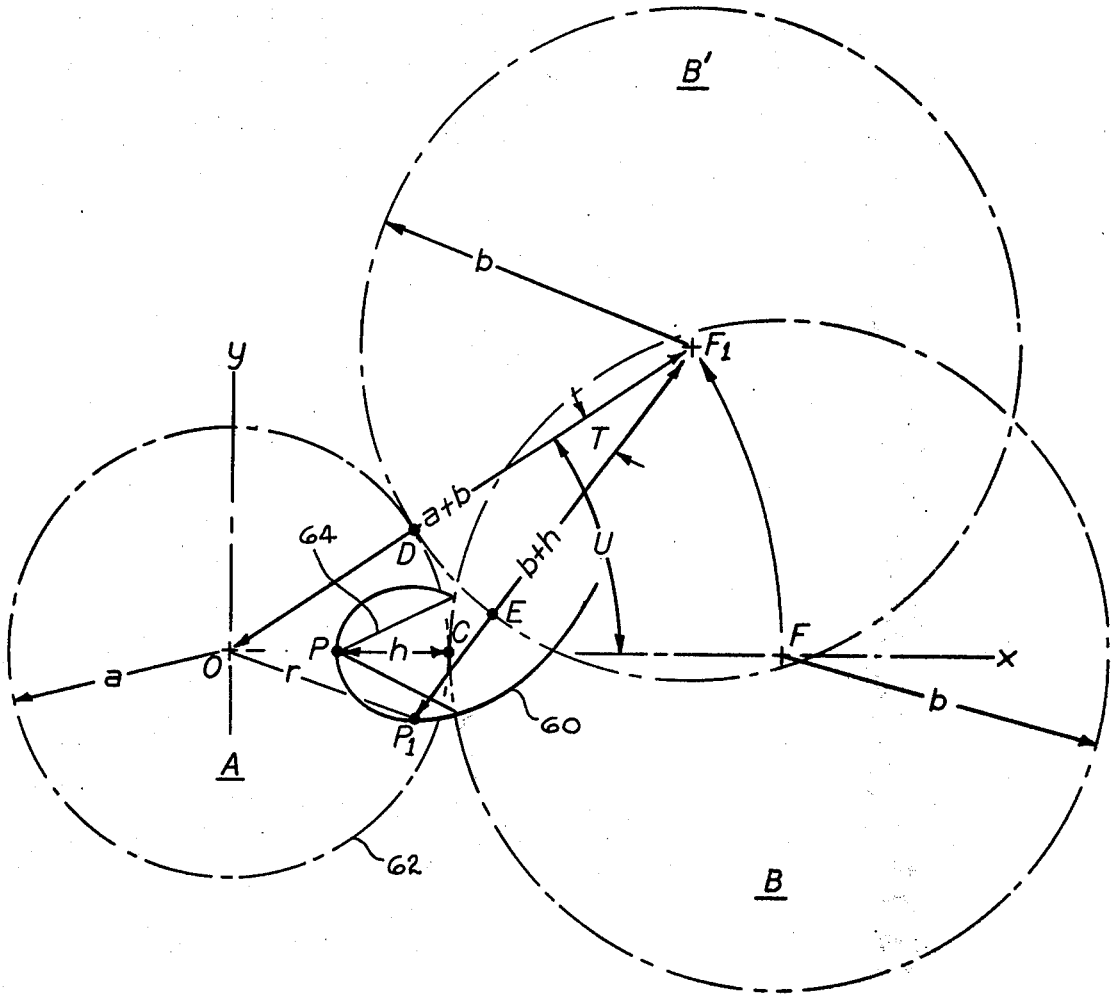
FIG. 3 is a layout showing the development of an endoepicycloid.

FIG. 3 is a layout showing how the designer may develop endoepicycloidal surfaces like those described in the previous figures. The curve 60 shown in the figure is generated by regarding one rotor A as fixed and centered at the origin O of a Cartesian coordinate system with X, Y coordinates and making use of the parameter r; ($r^2 = x^2 + y^2$). The second rotor is represented by a second circle B having an initial position wherein it is halved by the positive x-axis and is tangent to the circle A. The tracing point P is regarded as the tip of a line or rod of length h extending rigidly from the circumference of circle B; its initial position, as shown, is on the x-axis and extending into circle A, so that the initial coordinate of P are Y=0, X=a−h, where "a" is the radius of the fixed circle A (and "b" is the radius of circle B).

If circle B is now rolled around circle A with circumferential contact and no slippage, the rod of height h staying fixed to circle B, the tip will move along curve 60 to the location $P_1$, and rolling of circle B clockwise will produce the upper half or mirror image of the lower half of the curve. This endoepicycloid, of which only the reentrant loop, i.e., the part lying within circle A, is of interest, may be described mathematically by noting that the condition of no slippage means that arc DC = arc DE or aU = bT; cos T = cos a/b$^U$ and that in the triangle $OP_1F_1$ the law of cosines yields:

$$r^2 = (x^2 + y^2) = (a + b)^2 + (b + h)^2 - 2(a + b)(b + h)\cos T$$

With these starting conditions, one can readily derive the coordinates of the moving point P:

$$x = (a + b)\cos U - (b + h)\cos\frac{a + b}{b}U$$
$$y = (a + b)\sin U - (b + h)\sin\frac{a + b}{b}U$$

When the two circles have the same radius a, angle U = angle T and $$x = 2a\cos U - (a + h)\cos 2U$$
$$y = 2a\sin U - (a + h)\sin 2U$$

Similar equations are available expressing x and y only in terms of one another and the constants a and h, but they are move complicated and of less utility. For the points at which the point P just touches the circumference 62 of circle A, $$x_c = a\left[1 - 1/8\left(\frac{a}{h}\right)^3\frac{4a + h}{a + h}\right]$$
$$y_c = \pm\frac{h}{2}\left(\frac{4a + h}{a + h}\left(1 - \left(\frac{h}{2a}\right)^4\frac{4a + h}{a + h}\right)\right)^{1/2}$$

From this $y_c$, the straight line distance $2y_c$ between the corners of the mouth of the cavity may be determined.

It should be noted that the foregoing relationships may be utilized by suitable calculating and computer tape machines which control suitable machinery to very accurately machine the desired cavities in a rotor. Also noteworthy is the fact that the rolling circle technique may be used with less sophisticated machinery to scribe an outline to be machined away by directly operated milling machinery.

Figure 4:
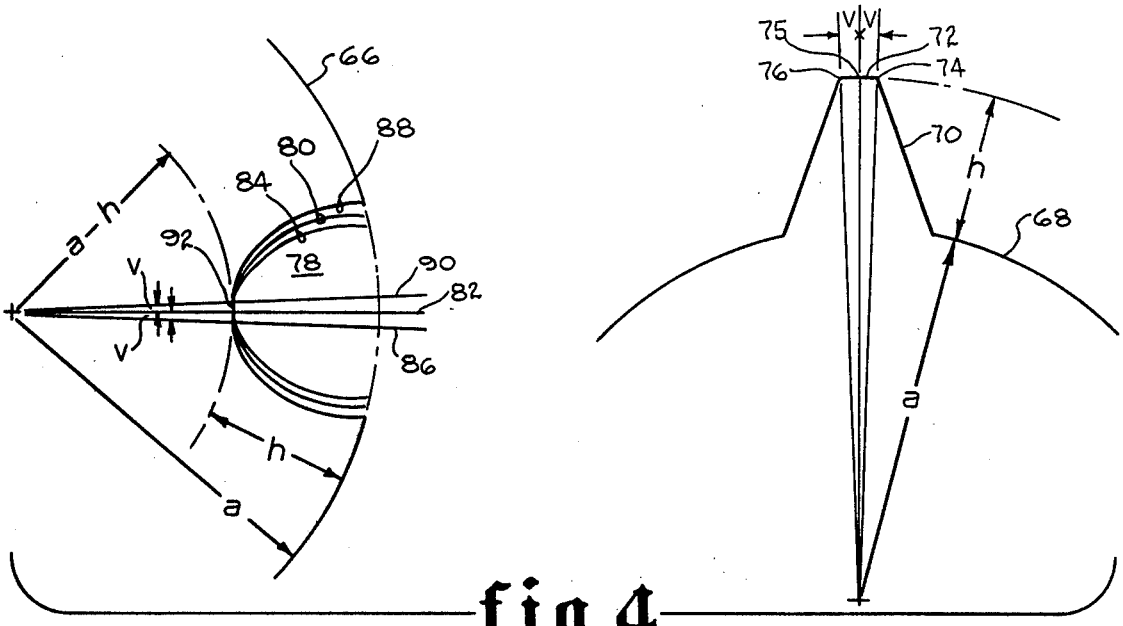
FIG. 4 is a layout showing the development of a cavity adapted to make a sliding-rolling seal with a lobe having a blunt tip.

While the simple endoepicycloidal cavity 60 of FIG. 3 will accommodate the sharp-tipped triangular lobe 64 shown in that figure, something additional is needed when the lobe has a tip of appreciable width. In FIG. 4 there is reproduced a layout showing a lobe 70 having a blunt tip 72 of arcuate configuration, with a radius equal to a + h, "a" being the common radius of the two rotors 66 and 68 and "h" the radial height of lobe 70. The corners 74 and 76 are separated from each other by the angle 2V, and each is separated from the center 75 by the angle V.

As the lobe 70 rolls through the cavity 78 of FIG. 4, it will be evident that both tip corners 74 and 76 will generate endoepicycloidal loops (hereinafter called "e. loops") identical with the e. loop 80 generated by the tip center 75. The only difference will lie in their locations, for while center 75 generates an e. loop 80 centered on radius 82 of the cavity rotor 66, corner 76 will generate an e. loop 84 centered on radius 86, displaced from the loop center radius 82 by the angle V, and similarly corner 74 will generate e. loop 88, displaced from the center loop 80, in the opposite direction, by the same angle V. In effect, the center loop is split in half and the halves are rotated in opposite directions through the angle V. If the rotor 66 is to be rotated counter-clockwise, corner 76 of the lobe tip will become the leading corner for sealing, so that only the lower half of e. loop 84 will be required, and this half will define the leading seal surface of cavity 78. Similarly, only the upper half of e. loop 88 will be required to define the trailing seal surface of the cavity, making sealing contact with trailing corner 74. The inward ends of these two surfaces, which in any event are tangent to a circle (cylindrical surface) of radius a − h, are then connected by a cylindrical bottom surface 92 which is coaxial with the pitch surface of rotor 66 and has a radius of a − h. In the interval after corner 76 has traversed the leading surface 84 and before corner 74 starts its traverse of trailing surface 88, the arcuate tip 72 rolls over the surface 92 just as any pair of tangent cylindrical surfaces, maintaining sealing contact therewith.

Figure 5:
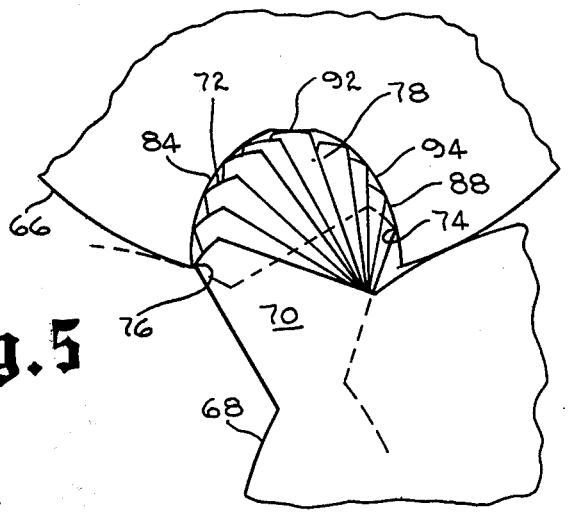
FIG. 5 is a layout showing successive positions of a lobe tip relative to the cavity engaged by the lobe as their two rotors rotate together.

FIG. 5 is a layout showing the composite profile 94 of cavity 78 resulting from the analysis accompanying the previous figure, and also shows successive positions of the lobe 70 as it rotates through cavity 78. From these it will be noted that only corner 76 of the lobe tip seals against the leading seal surface 84 of the cavity, while only corner 74 seals against trailing surface 88.

Figure 6:
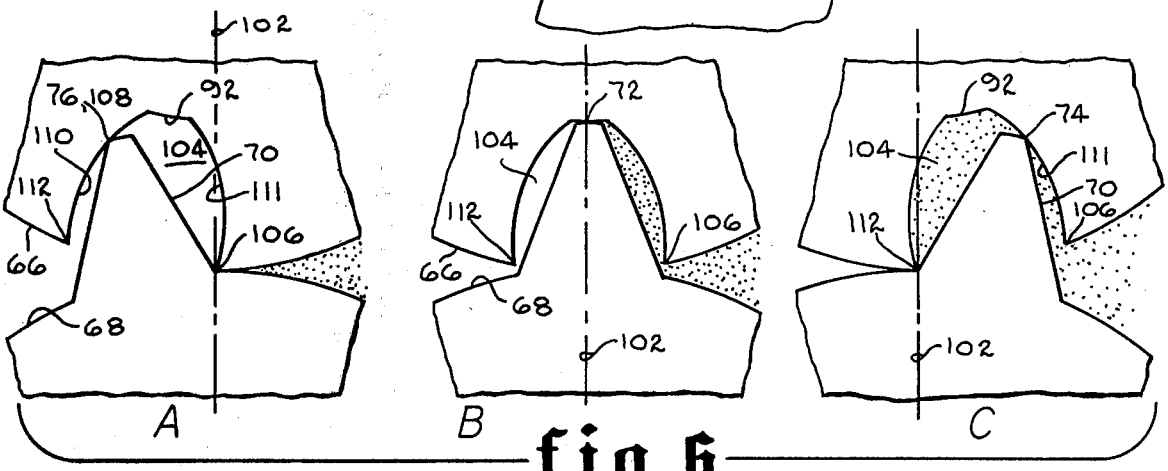
FIG. 6 is a layout showing interrelationships between a lobe, a cavity and the fluid flowing through the device.
Figure 7:
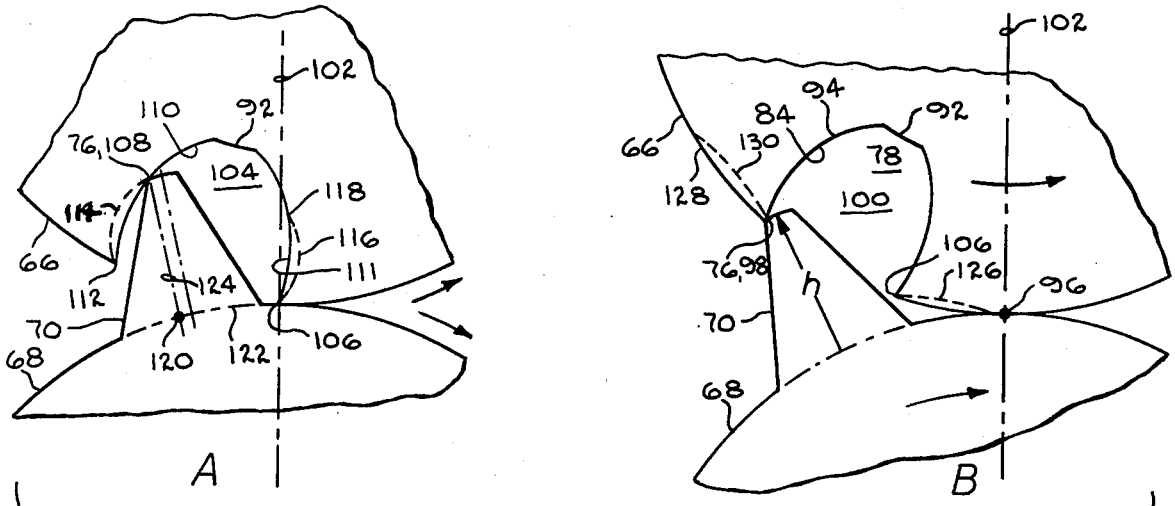
FIG. 7A is a layout illustrating undercutting of the cavity surfaces.
FIG. 7B is a layout illustrating undercutting of the pitch surface adjacent the mouth of a cavity.

FIGS. 6, 7A and 7B illustrate the relationships between two rotors of a device of the present invention, and show how various surface may be undercut to avoid the trapping of fluids, which is particularly desirable when the fluid is an incompressible liquid, and also to remove the engaging elements from their active torque transmitting activity over as small an angle of rotation as possible. Looking first at FIG. 7B, the problem can be appreciated by noting that, with rotors 66 and 68 having the unmodified contours illustrated, there will be two sealing contacts between the rotors, one between the pitch surfaces at 96 and the other between leading corner 76 of lobe 70 and the leading seal surface 84 of the cavity, just at the corner 98 where 84 intersects the pitch surface. This contact is more than momentary, as it will continue for some time as the rotors turn in the directions indicated, There may be fluid within the volume 100 between such two seals, and if such space is full of an incompressible liquid undesirable results will follow, e.g., movement of the rotors away from each other to open one of the seals and allow the escape of liquid, probably several rapid movements accompanied by hammering and, in time, accelerated bearing wear.

To avoid such results, it is preferable that sealing be accomplished as indicated in the three sequential layouts of FIG. 6, "A", "B" and "C". In the first of these the direct seal between the pitch surfaces of rotors 66 and 68 is just about to be broken, as indicated by the fact that the corner 106 of cavity 104 is just lying on the fixed line 102 between the centers of rotation of the two rotors. Since in another instant the direct seal between the rotors willdisappear, it is desirable that sealing between lobe 70 and the wall of cavity 104 commence at the same instant, at which time the leading corner 76 of the lobe tip is sealing along a line 108 against the leading seal surface 110 of the cavity 104. For condition A, note that there is no high pressure fluid, indicated by shading, in the cavity 104.

After the rotors have turned a little further, they will reach the positions indicated in FIG. 6B, wherein lobe 70 is centered in cavity 104 and its tip 72 makes sealing contact with the cavity bottom 92. High pressure fluid has entered the right hand portion of cavity 104 through the gap adjacent corner 106, but rather than being trapped such fluid is in equilibrium with the fluid lying between the pitch surfaces of rotors 66 and 68.

FIG. 6C portrays the mirror image of the first figure of the sequence, i.e., the rotors have now turned to the position where a seal has just been made, on the other corner 112 of the cavity mouth, between the pitch surfaces of the rotors. This is indicated by the fact that corner 112 is now located on the fixed line 102 joining the centers of the rotors. At such time the trailing corner 74 has descended down the trailing surface 111 of the cavity to the point 109, the shading indicating that the seal between 74 and 111 has just been broken. This permits the high pressure fluid to flow around corner 74 into the left hand side of cavity 104. If the seal remains broken during the balance of the traverse of this corner, fluid will continue to flow freely between parts of the cavity, thus avoiding any possibility of cavitation.

FIG. 7A portrays the rotors in the same relative position as in FIG. 6A, and indicates one seal-breaking structure. The seal between the pitch surfaces of rotor 66 and 68 is at corner 106 of the cavity mouth, and is just about to be broken. At this time lead corner 76 of the tip of lobe 70 is in sealing contact along line 108 with cavity surface 110. Since it is desired that the latter sealing contact commence at the moment shown but not before, one technique for removing the seal is to undercut that portion of surface 110 lying between the line of contact 108 and the lead corner 112 of the cavity mouth, as for instance by machining down to a new surface 114. By symmetry a similar machining line 116 may be determined on trailing seal surface 111, extending between a last seal line 118 and the trailing corner 106 of the cavity mouth, if it is desired to avoid cavitation (or the rotors are reversed). The construction lines 122 and 124 are used to fix the location of starting seal line 108, as by measuring circumferentially along 122 half the arcuate length of the cavity mouth plus half the arcuate length of tip 72 to the point 120, and then measuring radially along 124 the full height of the lobe.

FIG. 7B shows an alternate method of seal relief, one in which the cavity profile 94 is not altered. Rather the seal that is removed is on the pitch surface itself, either or both on rotor 66 and rotor 68. All that is necessary is to determine the location of point 96 for the condition indicated, when the leading corner 76 of the tip of lobe 70 has just made its first sealing contact with the cavity 78, at the lead corner 98. This can be done graphically or with the aid of the mathematics outlined above in discussing FIG. 3. Thereafter one or both pitch surfaces may be undercut, as by machining rotor 66 down to line 126 between seal line 96 and mouth corner 106. Similarly, the other side of the mouth may be machined down to 130 between mouth corner 98 and a last seal line 128.

In FIG. 8, there is shown a device 132 differing from that shown in FIG. 1 in having only cavities 140 on the meshing rotor 136. The cavity rotor 136 must fit into a smaller borewall to reduce or eliminate the fluid flow around its periphery, whereas lobes 138 sweep through an annulus 142. Only the lobe rotor 134 pushes or is pushed by the flowing fluid.

Figure 9:
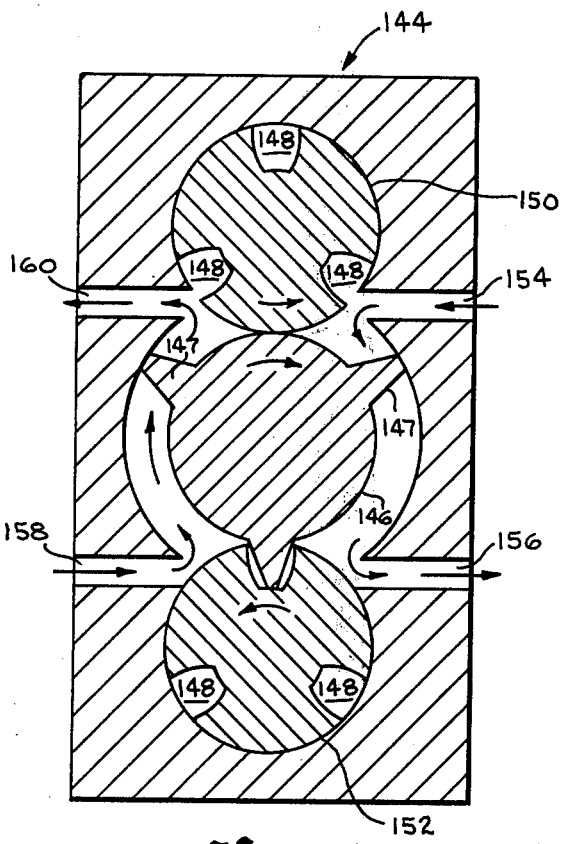
FIG. 9 is a similar cross section of a three rotor device, the center rotor having only lobes while the outside rotors have only cavities.

FIG. 9 illustrates a rotary device 144 of the invention having three rotors of one pitch diameter, the center lobe rotor 146 being the only active rotor. The lobes 147 intermesh alternately with the cavities 148 of the upper cavity rotor 150 and lower cavity rotor 152. This construction makes it possible to utilize two different flow streams, as indicated by the arrows, the fluid entering through intake 154 passing out through exhaust 156 while the fluid flowing into the device at 158 exits through the exhaust 160. Fluid from one stream may be carried into the other through cavities 148, which will promote a certain amount of intermixing.

In FIG. 10 there is shown a device 162 utilizing a cylindrical center stator 164 having axial flow paths therethrough. A planetary rotor 166 surrounds stator 164, being separated therefrom by an annulus 168 having a radial thickness equal to the height of the lobes 170 extending integrally from ring 166 toward the center of the device. In the appropriate recesses illustrated in stator 164 there are a pair of cavities rotors 172 rotatably mounted at opposed ends of a diameter, each rotor 172 containing a single cavity 174. Again the device has two distinct streams of fluid, one entering through inlet 176 and exhausting through 178 while the other enters through inlet 180 and passes out through exhaust port 182. It should be noted that both streams travel clockwise around annulus 168, each traveling one-half of its arcuate length.

The FIG. 10 device 162 illustrates that the contacting and sealing rotors need not be of the same size. The reader will recall that the FIG. 3 layout develops formulas for the endoepicycloidal cavities for the general case, where two rotors have unequal diameters, and are adequate for the design of the device 162. Of course, the contacting pitch surfaces in this case are the outer surfaces of the small rotors 172 and the inner cylindrical surface of the planetary rotor 166. These surfaces must move at the same linear speed, which is controlled by timing means not shown. In addition, the elements must be properly sized and spaced for repetitive engagement which in this instance means that the pitch diameter of each small rotor 172 must be ⅓rd the pitch diameter of the ring gear 166.

Finally FIG. 11 illustrates a cavity type central rotor 180 surrounded by a stator 182 containing in appropriate bores a multiplicity of smaller lobe rotors 184. A splitter 186 is used to divide the indicated inlet and outlet passages, and blocks 188 are used to direct the single flow stream from one peripheral rotor 184 to the next. When this device is used as a pump, it in effect it is a 4-stage pump for the four rotors 184 shown. Since each rotor 184 makes a complete revolution while the main rotor 180 turns ⅓rd of a revolution, again the ratio of the pitch surface diameters must be 3 to 1.

As an illustration of the power of devices such as those described, consider a fluid motor of the type shown in FIG. 1, with each rotor having a pitch surface radius of 4 inches, an axial length of 20 inches, and with a lobe height of 1 inch. Further assume that the effective arc during which fluid introduced at 3000 p.s.i. can act is 330 degrees, a rotary speed of 3600 rpm, and friction losses of 50%. Then $$\text{hp delivered} = .5 \times \frac{330}{360}\ \frac{TN}{5250} = \frac{165}{360} \times \frac{3000 \times 1'' \times 20'' \times \frac{4.5}{12} \times 3600}{5250} = 7000$$

a large delivery for any device not exceeding 12″ × 12″ × 26″ in overall dimensions.

It should be mentioned that the lobes of the rotors may have configurations other than those mentioned, so long as they will maintain the necessary sealing contact with the cavity and no point on the lobe profile generates an e. loop lying outside the cavity profile. The flanks of the lobe, for instance, are not limited to the flat contours shown, but may be rounded in various ways, which may be desirable, for example, in pump applications. Materials are not limited to those metals traditionally used for gears, but may include those plastics such as Nylon which will make good seals and will withstand the centripetal forces inherent in high speed devices.

Uses of the devices are myriad, e.g., fluid meters, pumps, power motors, steam engines, gas expansion engines, wheels, propellers, winches, gas and air compressors, compressor/power rotor combinations, etc. Many other applications will occur to those skilled in the art, as well as many variations of the basic structures disclosed. The inventive concept should not be limited except as described in the appended claims, which include all similar structure operating in substantially the same manner to obtain substantially the same results.

What is claimed is:

1. A fluid flow rotating machine of the lobe type comprising first and second intermeshing rotors having pitch surfaces in sealing tangential contact, said rotors being disposed on parallel axes of rotation and rotating with a common pitch surface speed, at least the first of said rotors having a generally chisel shaped lobe projecting radially outwardly from its pitch surface to terminate in a tip rounded with an arc centered on the center of said first rotor and with a radius equal to the sum of the radius of the pitch surface and the radial height of the lobe, said lobe tip having opposed leading and trailing corners, such lobe being symmetrical and having a cross-sectional base width greater than the width of said tip and not greater than approximately said height, at least said second rotor having a lobe receiving peripheral sealing cavity extending inwardly from said pitch surface making sealing and moving contact with said lobe tip, said cavity having a cylindrical bottom surface coaxial with its pitch surface, a radius equal to the difference between the radius of said second rotor and the height of said lobe, and an arc length equal to that of said lobe tip, the ends of said bottom surface of the cavity being joined to leading and trailing surfaces extending outwardly to said pitch surface and having profiles defined by the leading and trailing corners of said lobe tip as the rotor with the lobe is rolled around the rotor with the cavity without slipping, said lobe having a pair of opposed flanks extending between the leading and trailing corners of the tip and the pitch surface from which the lobe extends, said flanks being spaced from all surfaces of said cavity at all times, so that the only contacts between rotors when said pitch surfaces are not rolling over one another is between the tip of a lobe and the surfaces of the intermeshing cavity, said pitch surface of each rotor having a net undisturbed circumference at least equal to the portion of its circumference interrupted by said lobes and cavities.

2. The rotor of claim 1 in which said rotor containing the sealing cavity is modified to avoid double sealing by undercutting a portion of at least one of said leading and trailing surfaces of the cavity, between the line of intersection between such surface and the pitch surface of the rotor and the sealing line between such surface and the corner of the lobe tip corresponding to the position of the lobe rotor and the cavity rotor when a line joining the centers of the two rotors passes through the intersection of the other cavity surface and the pitch surface of the cavity rotor.

3. The rotor of claim 1 in which said rotor is modified to prevent double sealing by undercutting a portion of the pitch surface on one or both sides of the mouth of the cavity, between one corner of the mouth and the sealing line between the pitch surfaces of the two rotors corresponding to the position of the lobe rotor when said lobe tip seals against the opposite corner of the cavity mouth.

4. A fluid flow rotating machine of the lobe type comprising:

first and second intermeshing rotors, the first rotor having a number of lobe-receiving peripheral cavities therein each adapted to make sliding and sealing contact with the tip of a lobe projecting radially from the circumference of the second rotor, said rotors being mounted for rotation about parallel axes with their pitch surfaces in sealing contact and constrained to rotate with equal pitch surface velocities, said lobe having a profile of generally chisel shape with its outer end or apex truncated by an arc centered on the center of the second rotor and intersecting the not necessarily flat flanks of the chisel in a leading corner and a trailing corner, said cavity having a bottom surface, a leading surface extending from one end of the bottom surface to the pitch surface of its rotor and a trailing surface extending from the other end of the bottom surface to the pitch surface, said leading and trailing surfaces having profiles respectively determined by the leading and trailing half-loops of endoepicycloid formed by the traces of the leading and trailing corners of the lobe tip as the second rotor is rolled around the circumference of the first without slippage, and said bottom surface of the cavity having a circular arc profile centered on the center of the first rotor and a radius equal to the difference between the pitch surface radius of the first rotor and the radial height of said lobe, said flanks of the lobe diverging from the leading and trailing corners of the apex and extending to and joining the pitch surface of the second rotor with a base width greater than the width of said apex, said flanks being spaced from all surfaces of the first rotor at all times so that only said leading and trailing corners of the apex of the lobe contact said leading and trailing surfaces of the intermeshing cavity, said pitch surface of each rotor having a net undisturbed circumferential portions after subtracting that portion of such surface which is interrupted by outwardly extending lobes and inwardly extending cavities, said undisturbed portions of the pitch surfaces maintaining a rotor-to-rotor seal when the lobe apices are out of contact with said cavities.

5. The device of claim 4 in which said first and second rotors have unequal pitch diameters.

6. The device of claim 4 in which said first and second rotors have equal pitch diameters.

7. The device of claim 4 in which each of said first and second rotors has both lobes and lobe-receiving cavities, said lobes and cavities of the first rotor being circumferentially spaced from one another to make sealing contact with the cavities and lobes of the second rotor.

8. The device of claim 4 in which one of said rotors has only lobes and the other has only cavities.

9. The device of claim 4 which further includes a third rotor mounted for rotation about an axis parallel to the axes of said first and second rotor and making sealing peripheral contact with one of them, said third rotor having lobes and cavities disposed to make sealing engagement with the cavities and lobes of the rotor it engages.

10. A rotary fluid actuator comprising a pair of rotors disposed for rotation with equal pitch surface velocities about their individual axes and with said axes parallel, each said rotor having a cylindrical pitch surface making sealing contact with the cylindrical surface of the other, each said cylindrical pitch surface being interrupted by a plurality of engaging elements consisting of outwardly extending lobes and inwardly extending cavities, said engaging elements being circumferentially spaced so that during rotation each lobe of one rotor engages a cavity of the other and makes sealing contact with the wall of the cavity during at least that fraction of the engagement period when there is no sealing engagement between said cylindrical pitch surfaces, each said lobe having a cross-section having the general shape of an isosceles triangle with a slightly blunted tip, said tip having opposed leading and trailing corners, and each said cavity having a cross-section in the general form of an endoepicycloid having a maximum radial depth equal to the radial height of the engaging lobe, the halves of the endoepicycloid being separated from each other and joined by an arc having a radius equal to the difference between the radius of the circumferential surface of the rotor containing the cavity and the said maximum radial depth of the cavity, and a length equal to the width of the tip of the intermeshing lobe, each said lobe having a pair of opposed flanks extending between the leading and trailing corners of the tip and the pitch surface from which the lobe extends, said flanks being spaced from all surfaces of said cavity at all times, so that the only contacts between rotors when said pitch surfaces are not rolling over one another is between the tip of a lobe and the surfaces of the intermeshing cavity, said pitch surface of each rotor having a net undisturbed circumference at least equal to the portion of its circumference interrupted by said lobes and cavities.

11. The rotary fluid actuator of claim 10 in which the endoepicycloidal cavity is defined by the equations:

$$y = (a + b)\sin\theta - (b + h)\sin\frac{a + b}{b}\theta$$

$$x = (a + b)\cos\theta - (b + h)\cos\frac{a + b}{b}\theta$$

where a = the radius of a fixed circle having its center at the intersection of the x and y axes of a Cartesian coordinate scheme b = the radius of a circle rolling around the circumference of the circle of radius "a", without slipping $\theta$ = the angle between the x-axis and a line joining the centers of the two circles h = the radial distance between the circumference of the circle of radius "b" and a point rotating with such circle as though fixed thereto, and x and y are the coordinates of such moving point.

* * * * *